US005103380A

United States Patent [19]

Lindner et al.

[11] Patent Number: 5,103,380

[45] Date of Patent: Apr. 7, 1992

[54] CHRISTMAS TREE LIGHT APPARATUS

[76] Inventors: Antony M. Lindner; Anthony Lindner, both of 1819 Palamino Rd., Clarksville, Tenn. 37042

[21] Appl. No.: 610,168

[22] Filed: Nov. 5, 1990

[51] Int. Cl.[5] ..... F21V 7/04

[52] U.S. Cl. ..... 362/32; 362/123; 362/85

[58] Field of Search ..... 362/32, 85, 95, 123, 362/190, 191

[56] References Cited

U.S. PATENT DOCUMENTS 3,263,353 8/1966 Quinn ..... 362/123
4,206,495 6/1980 McCaslin ..... 362/32

FOREIGN PATENT DOCUMENTS 3735217 4/1989 Fed. Rep. of Germany ..... 362/123
3642890 7/1989 Fed. Rep. of Germany ..... 362/123

*Primary Examiner*—Carroll B. Dority
*Attorney, Agent, or Firm*—Leon Gilden

[57] ABSTRACT

A Christmas tree light attachment apparatus is provided with a clip member to permit selective securement to an associated Christmas tree or other suitable support. The organization includes an illumination bulb operative through a switch member, and a battery to effect actuation of the illumination member. The switch may be remotely actuated in an embodiment of the invention, and may further utilize a helical fiber optic cord to effect an enhanced illusion from the illumination member disproportionate to the illumination member's size and configuration.

1 Claim, 4 Drawing Sheets

PRIOR ART

CHRISTMAS TREE LIGHT APPARATUS

BACKGROUND OF THE INVENTION

1. Field of the Invention

The field of invention relates to ornamental light construction, and more particularly pertains to a new and improved Christmas tree light apparatus wherein the same permits selective mounting and illumination of the invention.

2. Description of the Prior Art

Various illumination devices of a portable nature have been provided in the prior art. The instant invention has set forth an organization that permits a compact conveniently positionable illumination device to be mounted as desired by an individual upon a suitable support, such as a Christmas tree, a garment of cloting, and the like and selectively actuated by a remote control transmitter organization. Examples of the prior art includes U.S. Pat. No. 4,521,832 to Barbour setting forth a wrist mounted device utilizing a self-contained battery illumination bulbs for providing portable illumination.

U.S. Pat. No. 4,680,683 to Schenke, et al. sets forth a tubular device mounting batteries in operative association with a bulb member.

U.S. Pat. No. 4,839,784 to Lin sets forth a candle-like device utilizing battery power and simulating a candle-like organization.

U.S. Pat. No. 4,432,042 to Zeller sets forth a portable book light readily mounted to an associated book for permitting reading thereof during periods of limited light.

U.S. Pat. No. 4,559,583 to Keu sets forth a lighting device mounted within a greeting card and the like utilizing a light emitter and a length of fiber optic cord in communication with the light emitter incorporating means for the light transmitted within the fiber optic tube and exterior thereof, such as within a greeting card type structure.

As such, it may be appreciated that there continues to be a need for a new and improved Christmas tree light apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of lighting apparatus now present in the prior art, the present invention provides a Christmas tree light apparatus wherein the same permits portable and selective securement of the organization through a convenient support member. As such, the general purpose of the present invention, which will be described subsequently in greater detail, is to provide a new and improved Christmas tree light apparatus which has all the advantages of the prior art light apparatus and none of the disadvantages.

To attain this, the present invention provides a Christmas tree light attachment apparatus with a clip member to permit selective securement to an associated Christmas tree or other suitable support. The organization includes an illumination bulb operative through a switch member, and a battery to effect actuation of the illumination member. The switch may be remotely actuated in an embodiment of the invention, and may further utilize a helical fiber optic cord to effect an enhanced illusion from the illumination member disproportionate to the illumination member's size and configuration.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved Christmas tree light apparatus which has all the advantages of the prior art light apparatus and none of the disadvantages.

It is another object of the present invention to provide a new and improved Christmas tree light apparatus which may be easily and efficiently manufactured and marketed.

It is a further object of the present invention to provide a new and improved Christmas tree light apparatus which is of a durable and reliable construction.

An even further object of the present invention is to provide a new and improved Christmas tree light apparatus which is susceptible of a low cost of manufacture with regard to both materials and labor, and which accordingly is then susceptible of low prices of sale to the consuming public, thereby making such Christmas tree light apparatus economically available to the buying public.

Still yet another object of the present invention is to provide a new and improved Christmas tree light apparatus which provides in the apparatuses and methods of the prior art some of the advantages thereof, while simultaneously overcoming some of the disadvantages normally associated therewith.

Still another object of the present invention is to provide a new and improved Christmas tree light apparatus wherein the same is of convenient, compact, and portable configuration permitting its selective securement as desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
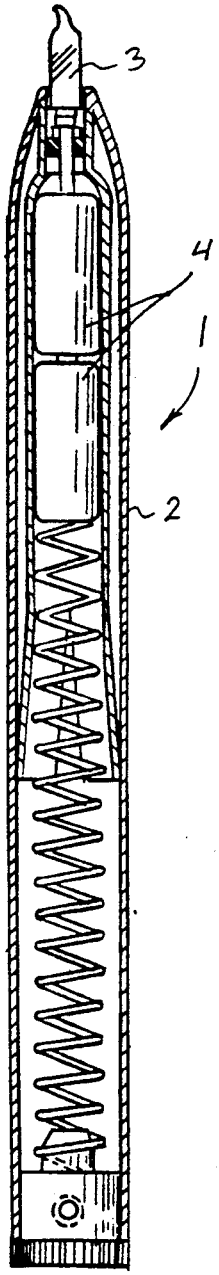
FIG. 1 is an orthographic cross-sectional illustration of a prior art light apparatus.

With reference now to the drawings, and in particular to FIGS. 1 to 9 thereof, a new and improved Christmas tree light apparatus embodying the principles and concepts of the present invention and generally designated by the reference numeral 10 will be described.

Figure 2:
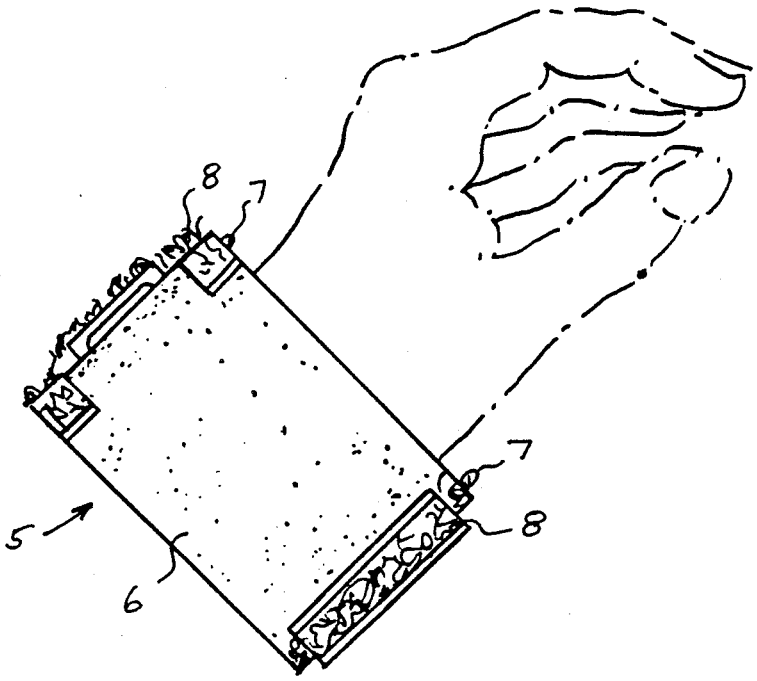
PRIOR ART FIG. 2
FIG. 2 is an orthographic view of a further example of a prior art light apparatus.
Figure 3:
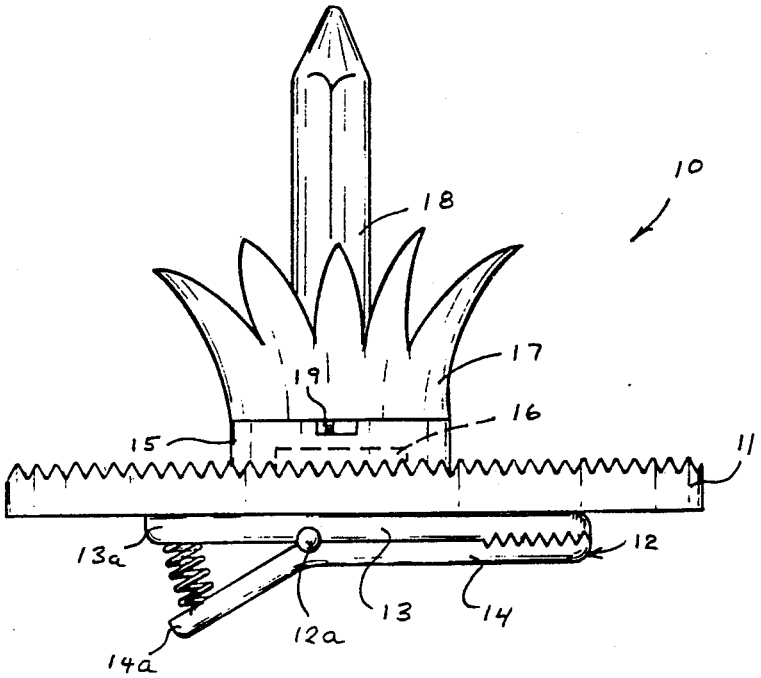
FIG. 3 is an orthographic side view, taken in elevation, of the instant invention.
Figure 4:
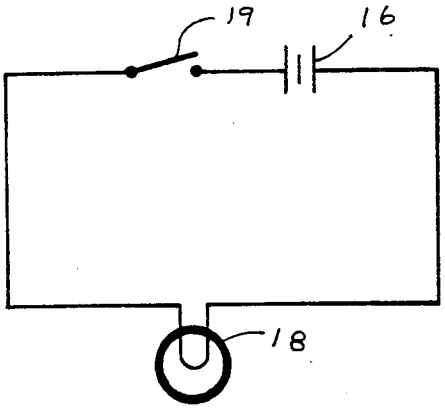
FIG. 4 is a diagrammatic illustration of a circuit utilized by the instant invention.
Figure 5:
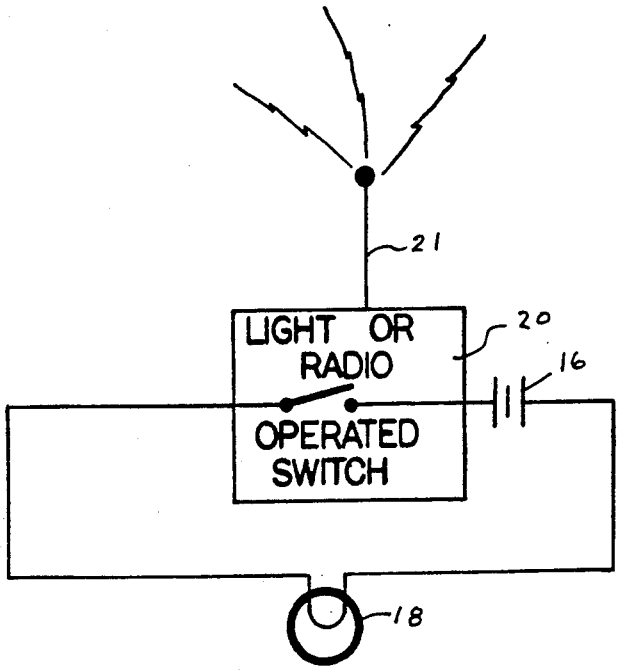
FIG. 5 is a diagrammatic illustration of a further circuit utilized by a modification of the instant invention.
Figure 6:
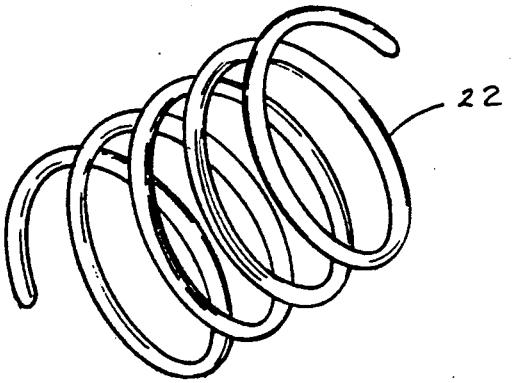
FIG. 6 is an isometric illustration of a fiber optic coil utilized by the instant invention.
Figure 7:
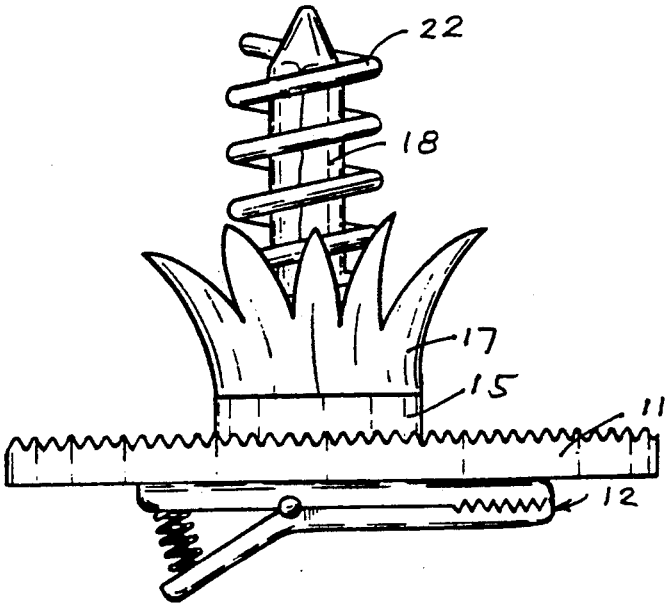
FIG. 7 is an orthographic side view, taken in elevation, of the fiber optic coil in association with the light organization.
Figure 8:
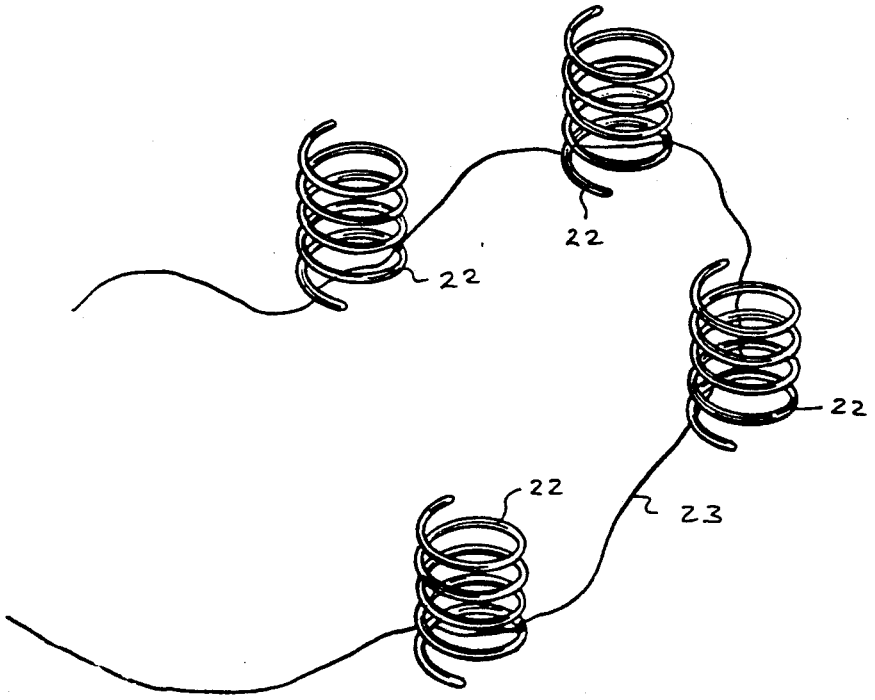
FIG. 8 is an isometric illustration of a series of light coils secured together by a flexible tether.
Figure 9:
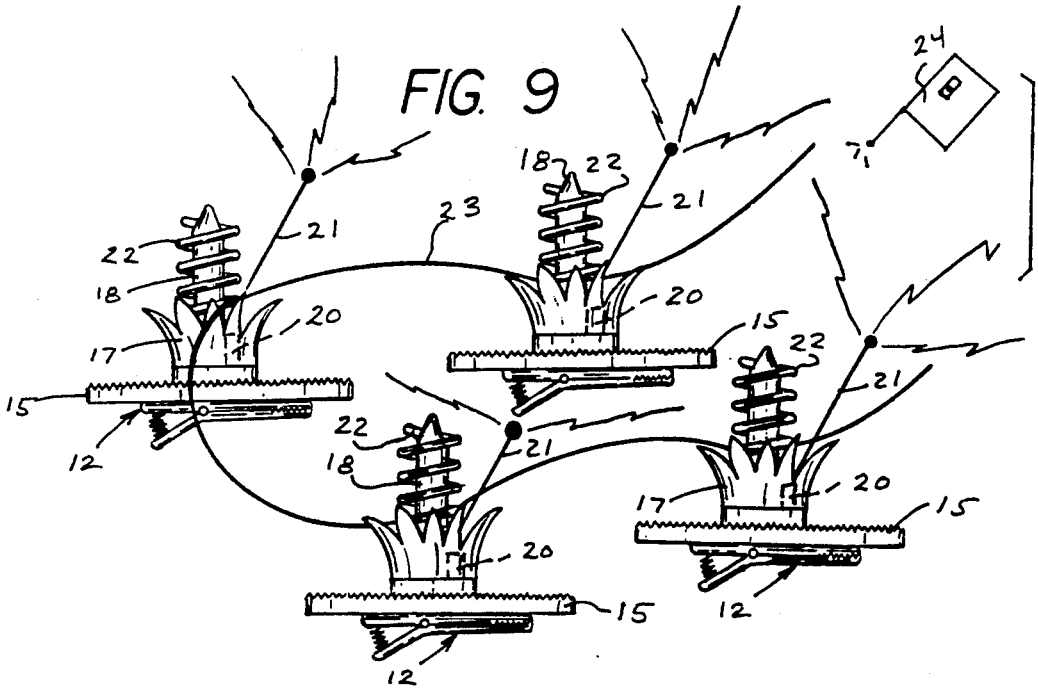
FIG. 9 is an isometric illustration of series of light organizations setting forth the instant invention.

FIG. 1 illustrates a prior art light apparatus 1, wherein a cylindrical tube 2 mounts a plurality of batteries 4 to effect illumination of a bulb member 3 in a portable arrangement as set forth in U.S. Pat. No. 4,680,683. FIG. 2 illustrates a further prior art portable light structure 5, wherein a wrist belt 6 includes a plurality of light members 7 and a self-contained battery, with the belt secured about a wrist by use of conventional hook and loop fasteners 8.

More specifically, the Christmas tree light apparatus 10 of the instant invention essentially comprises a support base 11, with a spring clip member 12 fixedly mounted to a bottom surface of the support base. The spring clip member includes a fixed jaw 13 fixedly mounted to the bottom surface of the support base 11, with a pivotal jaw 14 pivotally mounted to the fixed jaw, with a pivot axle 12*a* orthogonally directed intermediate forward and rear terminal ends of the fixed and pivotal jaws 13 and 14. Upon manual deflection of the pivot handle 14*a* towards the fixed jaw handle 13*a* against a captured biasing spring fixedly mounted between the fixed jaw handle 13*a* and pivoted jaw handle 14*a*, the pivotal jaw 14 is separated relative to the fixed jaw 13 to permit its securement to a support member, such as a Christmas tree. A housing 15 contains a battery, such as a lithium type battery 16 therewithin. A socket 17 selectively receives an illumination bulb 18 therewithin. A switch 19 selectively actuates the illumination bulb 18 in a manner as set forth in FIG. 4. Alternatively, the use of a light or radio-activated switch 20 may be utilized to include a transmitter 24 available to optionally actuate the switch 20. A sensor rod 21 is mounted within and extending outwardly from the socket 17 to receive the light or radio transmitted signal, in a manner to complete the circuit as set forth in FIG. 5 for example.

A modification of the invention utilizes a fiber optic helical cable frictionally mounted about the illumination bulb to enhance an illusory effect of the bulb as to the bulb's geometrical proportions thereby providing an enhanced sensory perception proportionate to the physical dimensions of the bulb 18. Further, a flexible tether line 23 may be utilized and secured at spaced intervals to a plurality of fiber optic handle cables 22 mounted about associated bulbs 18. This array may be mounted in a desired geometric pattern as desired by an individual. The tether line additionally prevents loss of the helical coils and permits their easily being positioned in frictional engagement about respective illumination bulbs, in a manner as set forth in FIG. 9.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Christmas tree light apparatus comprising, in combination, a support base, the support base including a top surface spaced from a bottom surface, the bottom surface including a spring clip member fixedly mounted thereon, and the top surface including a housing, with the housing mounting a self-contained battery therewithin, and a socket member mounted on the housing, and an illumination bulb received within the socket in electrical communication with the battery, and switch means within the housing to effect electrical communication between the battery and illumination bulb, and wherein the spring clip member includes a fixed jaw and a pivotal jaw, the fixed jaw is mounted coextensively of its length to the bottom surface of the support base, and a pivotal jaw including a pivot axle pivotally mounting the pivotal jaw to the fixed jaw, with a fixed jaw handle and a pivoted jaw handle extending rearwardly of the pivot axle, with a spring member captured between the fixed jaw handle and the pivoted jaw handle to bias the fixed jaw and pivotal jaw together, and wherein the switch means includes a radio activated switch, and a transmitter to selectively effect actuation of the switch to complete electrical communication between the battery and the illumination bulb, and the radio activated switch including a sensor rod extending exteriorly of the socket for effecting communication between the transmitter and the radio activated switch, and wherein the illumination bulb includes a fiber optic helical cable frictionally mounted about the illumination bulb coextensively thereof for enhanced visual effect, and including a further plurality of fiber optic helical cables, the helical cables secured together by an elongate flexible tether line, and each fiber optic helical cable frictionally mounted about a respective illumination bulb, and each illumination bulb contained within a respective socket, and each socket contained upon a respective support base, each support base including a respective spring clip mounted to a bottom surface thereof.

* * * * *